United States Patent [19]

Rapp

[11] Patent Number: 4,760,632

[45] Date of Patent: Aug. 2, 1988

[54] METHOD AND APPARATUS FOR JOINING PLATES BY STAMPING PRESSING AND SWAGING DIES

[76] Inventor: Eugen Rapp, Max-Reger-Str. 4, 7981 Berg, Fed. Rep. of Germany

[21] Appl. No.: 906,870

[22] Filed: Sep. 15, 1986

[30] Foreign Application Priority Data

Sep. 14, 1985 [DE] Fed. Rep. of Germany ..... 3532899

[51] Int. Cl.[4] ..... B23P 11/00

[52] U.S. Cl. ..... 29/432.1; 29/21.1; 29/243.5; 29/509; 29/521; 29/809

[58] Field of Search ..... 29/432, 432.1, 432.2, 29/509, 521, 798, 243.52, 243.5, 21.1

[56] References Cited

U.S. PATENT DOCUMENTS

| | | | |
|---|---|---|---|
| 2,671,361 | 3/1954 | Sandberg | 29/21.1 X |
| 2,811,880 | 11/1957 | Williams | 29/21.1 UX |
| 3,599,318 | 8/1971 | Behlen | 29/21.1 X |
| 3,919,955 | 11/1975 | Du Vernay | 29/509 |
| 4,208,776 | 6/1980 | Schleicher | 29/21.1 X |
| 4,312,122 | 1/1982 | Gunter | 29/243.5 X |
| 4,403,409 | 9/1983 | Richards | 29/521 X |

FOREIGN PATENT DOCUMENTS

| | | | |
|---|---|---|---|
| 526042 | 5/1955 | Italy | 29/432.2 |

*Primary Examiner*—Charlie T. Moon
*Attorney, Agent, or Firm*—Edwin E. Greigg

[57] ABSTRACT

A method for joining stacked thin plates (metal sheets in particular) or plate sections by stamping dies, and an apparatus for performing the method, in which stacked plate portions are severed by stamping them along a longitudinal portion of their peripheries and pressed them out of the plane of the plate, and in which subsequently, by means of a counterpressure die element, the plate portion nearer the plates is enlarged on the cut sides by swaging, yet without the plate portion remote from the plates being enlarged. Further, during the stamping and pressing operation the counterpressure die element, or the swaging die, remains stationary inside the bottom die 2, but subsequently, during the coining operation that generates higher pressing forces, the yields counter to an elastic supporting force, whereupon the flowing material of the plate piece nearer the plates forms flange portions which grip the plate associated with it from behind.

8 Claims, 2 Drawing Sheets

FIG. 1
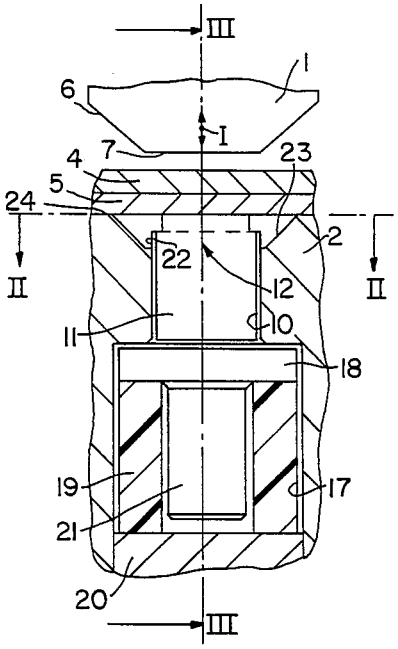
FIG. 3
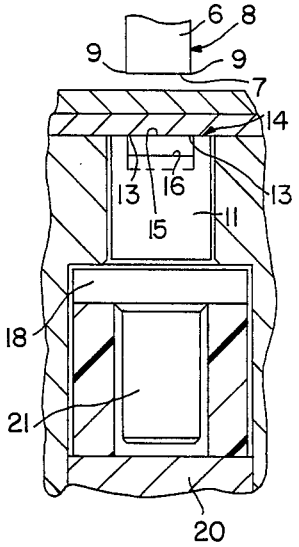
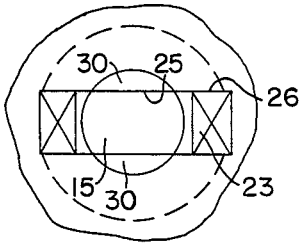
FIG. 2
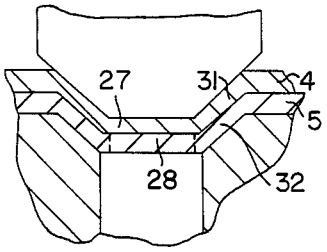
FIG. 6

METHOD AND APPARATUS FOR JOINING PLATES BY STAMPING PRESSING AND SWAGING DIES

BACKGROUND OF THE INVENTION

The invention is directed to a method for joining thin plates stacked on one another by stamping pressing and swaging dies and to an apparatus for performing the method.

Connecting metal sheets by means of stamping dies has already been known for a long time (German Patent No. 8 73 237). The main problem in this joining technique is in processing the material precisely, with a corresponding ability to replicate the joining quality. This technique is particularly complicated because of the fact that in it, a deep-drawing and stamping operation is combined with an ensuing upsetting or swaging operation, and while the relative tool movement between the upper die and the bottom die is effected coaxially, the movement of the material takes place first in this same axis but later, in the course of the swaging operation, radially thereto. Controlling this radial movement in terms of replicability is particularly difficult.

In a known method and apparatus for performing this joining method of the type defining the prior art (German Patent No. 23 38 460), after the stamping and pressing operation the bottom die is retracted relative to the counterpressure face, which in this case is provided on a flattening die, far enough that only one of the two pieces of plate is located inside the bottom die, so that only the other piece of plate can be enlarged during the swaging operation. This method has the disadvantage that the plates that are fixed in place for being worked on are loosened when the bottom die is retracted, and this retraction gives rise to the danger that the plates will not be joined together in a form-fitting manner. A further substantial disadvantage is that the apparatus has to be relatively complicated in structure, in order to perform this retraction of the bottom die while simultaneously retaining the flattening die in position. Still another disadvantage resides in that a further operation is required in order to eject the workpiece from the bottom die.

OBJECT AND SUMMARY OF THE INVENTION

The method according to the invention and the apparatus for performing the method have the advantage over the prior art that in one working stroke of the stamping and pressing die, which is therefore readily controlled, the entire joining connection is produced, namely stamping, pressing and swaging, and only the piece of plate that is required for the interlocking is swaged.

It is another object of the invention that the counterpressure required for the stamping operation be less than that required for the swaging operation, thus it is possible with very simple static means to control the resiliency of the counterpressure surface, so that only after the required shearing operation when stamping has ended does the counterpressure surface yield, after which it then remains in a correspondingly displaced position for the swaging operation.

It is still another object to provide an elastic means to control the resiliency of the counterpressure surface and simultaneously serve as an ejector means for ejecting the workpiece from the bottom die. Mechanical or hydraulic springs can serve as the elastic means.

It is yet another object of the invention that the force of the elastic element can also be transmitted via a hydraulic column, so that a pressing apparatus operating by hydraulic means can be used, which above all has advantages in terms of saving space.

It is yet a further object of the invention that the plates to be joined may be metal sheets; however, one or the other thereof may also be of plastic.

The invention will be better understood and further objects and advantages thereof will become more apparent from the ensuing detailed description of a preferred embodiment taken in conjunction with the drawing.

BRIEF DESCRIPTION OF THE DRAWINGS

FIG. 1 is a section taken through the tool according to the invention;

FIG. 2 is a view of the bottom die taken along the line II—II of FIG. 1;

FIG. 3 is a section through the tool taken along the line III—III of FIG. 1;

FIG. 6 is a section taken along the line VI—VI of FIG. 5 through a portion of the tool, corresponding to the location of the section in FIG. 1.

DESCRIPTION OF THE PREFERRED EMBODIMENT

Figure 4:
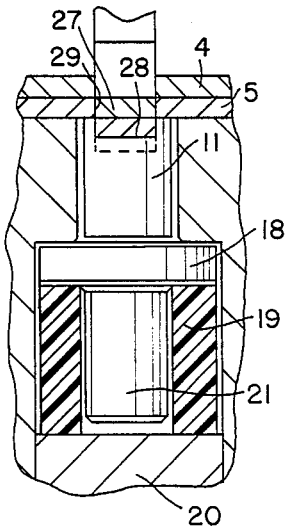
FIG. 4 shows a tool position after the stamping operation is completed.

In FIGS. 1–6, only the actual manufacturing tool itself is shown, in various sectional views and working positions. It is to be understood that such a method and tool require for manufacturing use a pressing apparatus, which naturally must be suitable for performing the method according to the invention but may be embodied in many known ways.

Considering FIG. 1, there are shown two plates 4 and 5, for example, metal sheets that are to be joined together, disposed between an upper stamping and pressing die 1, which is adapted to reciprocate via the pressing apparatus, and a fixed bottom die 2. Naturally, the workpieces 4 and 5 may also be any kind of bands or corner elements that are to be joined to a plate.

The upper stamping and pressing die that can reciprocate as indicated by the double arrow I is rectangular in cross section, with two end faces 6 oriented oblique to the working direction I, and one end face 7 extending at right angles to the working direction. Cutting edges 9 (see FIG. 3) are formed between these end faces 6 and 7 and the flat sides 8 of the upper die 1.

The bottom die 2 has a central bore 10, in which a cylindrical swaging die 11 is disposed in an axially displaceable manner. This swaging die 11 has a cutting die 12 on its upper end, the cutting edges 13 of which cooperate with the cutting edges 9 of the stamping and pressing die 1. The cutting edges 13 comprise edges between the upper end face 14 of the swaging die 11 and a transverse groove 15, the bottom face 16 of which serves as a counterpressure face during the swaging operation.

The swaging die 11 has a collar 18, guided in an enlarged section 17 of the central bore 10, which is engaged by an elastic element 19, shown only symbolically here, secured against twisting in the bores 10 and 17 by means not shown. As a result, the rotational position of the swaging die 11 inside the bottom die 2 is assured. The elastic element 19 is supported on its extremity remote from the collar 18 on a bottom 20, which serves also as a stroke limiting stop for the swaging die 11; that is, a tang 21 of the swaging die 11, after traveling a predetermined stroke, counter to the force of the elastic element 19, strikes this bottom 20.

After traveling this predetermined stroke, the bottom face 16 of the transverse groove 15 of the swaging die 11 stops flush with the bottom face 22 of diametrically opposed radially inwardly tapered slots 23, which is provided in the bottom die 2 with faces complemental to the end faces 6 and 7 of the stamping and pressing die 1. The cutting edge 26 formed between the bearing face 24 of the bottom die 2 and the walls 25 of slots 23 cooperates with the cutting edges 9 of the stamping and pressing die 1 associated with it. The width of the slots 23 corresponds to the width of the transverse groove 15 of the die 11.

The method of joining thin plates according to the invention is as follows, in terms of the example shown here:

After the plates 4 and 5 have been placed on the bearing surface 24 (FIGS. 1 and 3), the stamping and pressing die 1 is displaced, for the stamping operation, in the direction of the bottom die 2, whereupon the corresponding plate sections 27 and 28, which produce the connection are to be stamped out and then pressed at their longitudinal peripheries, are sheared by the cutting edges of the stamping and pressing die 1 in cooperation with the cutting edges 13 and 26 of the die 2. Eventually, plate section 27 will be pressed into the transverse groove 15, and plate section 28 will be pressed into the diametrically opposed radially inwardly tapered slots 23.

When cut and pressed out, the plate portion 28 becomes fixed laterally by means of the limiting walls of the groove 15 and its bottom face 16 as well as by the slots 23. At the end of this first operation, contrarily, the plate portion 27 which has been cut or pressed out of the plate 4 has been embedded in the cavity 29 of the lower plate 5 that was created by the lower plate portion 28 being stamped or pressed out thereof.

For the swaging operation that now follows, the stamping and pressing die 1 continues without interruption to move in its working direction, whereupon the force applied to the swaging die 11 causes it to yield and move counter to the force applied by the elastic element 19, and the material to be swaged comprising the plate 4 begins to flow. Only when the tang 21 of the die 11 is resting on the bottom 20 and the resistance thus arising causes the swaging die 11 to stop does the upper plate portion 27 begin to expand, whereupon its material flows into the spaces that have been created above the upper end face 14 of the swaging die 11 by the displacement of the swaging die. A cross sectional view of these spaces corresponds to the segmental faces 30 shown in FIG. 2. The working movement of the stamping and pressing die 1 is then continued slightly beyond the plane of the underside of the lower plate 5, so that some material from the upper plate portion 27 also flows into the transverse groove 15. In any case, however, the direct connection between the plates 4 and 5 and between the plate sections 27 and 28 is maintained, as FIG. 6 shows, by means of the flange portions 31 and 32 that are pressed into the frusto-conically shaped slots 23.

Figure 5:
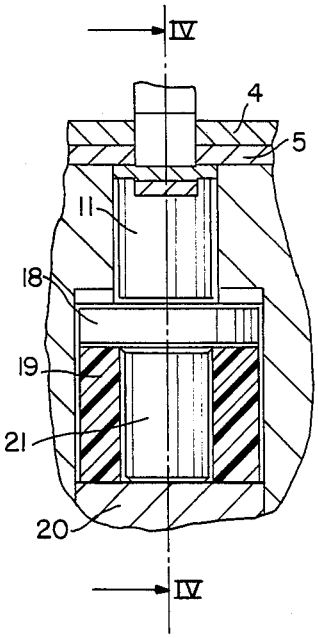
FIG. 5 shows a tool position after the swaging operation is completed.

The swaging operation results in substantially semicircular integral tabs being formed on plate section 27, which abut the underside of the plate 5 to lock plates 4 and 5 together thereby, as best shown in FIG. 5. Thereafter, as soon as the stamping and pressing die 1 is retracted, the thus joined workpiece 4, 5 is ejected from die 2 by means of the upward force exerted by elastic element 19 upon the swaging die 11 when the force applied by die 1 has been removed.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for joining at least two stacked thin plates, in particular metallic sheets, comprising the steps of:

(1) orienting and aligning the stacked plates between an upper stamping die having shaped cutting edges and a bottom die having a shaped recess with cutting edges of complemental shape to said stamping die and provided with a swaging die having a diametrically-notched circular top portion, said bottom die having diametrically opposed inwardly tapered slots adjacent and aligned with said diametrically-notched circular top portion;

(2) depressing the stamping die upon the stacked plates so as to press them against the bottom die thereby severing longitudinal plate portions from said stacked plates and further pressing a first lower longitudinal plate portion of a lower plate into the shaped recess in said bottom die and said diametrically-notched circular top portion of said swaging die;

(3) continuing to exert pressure via said stamping die upon said bottom die thereby causing the swaging die to be depressed overcoming an upwardly exerted force supplied by an elastic return means, the swaging die traveling a predetermined extent to abut a stop means and the stamping die traveling into a position just below a plane defined by an underside of the lower plate;

(4) exerting still further pressure upon the plate sections whereupon a material comprising a second longitudinal upper plate portion is swaged to form tab means over the circular top portion of said swaging die which adjoin the underside of said lower plate; and (5) retracting the stamping die causing the elastic return means to eject the thus joined plates from a work station.

2. An apparatus for joining overlapped plate sections in a stamping, pressing, and swaging operation, comprising a bottom die disposed on a press means, said bottom die including an outer planar end and a circular central bore, a swaging die disposed in said central bore and arranged to be axially displaceable relative to said bottom die, said swaging die including a transverse groove having edges that define a cutting die on its upper end, a stamping and pressing die positioned axially above said bottom die and adapted to be reciprocably driven by the press means, said bottom die further including diametrically opposed radially inwardly tapered slots having cutting edges juxtaposed said cutting die, said swaging die including a collar, an elastic element disposed in said central bore beneath said collar, said elastic element being supported on a bottom element stop and adapted to render said swaging die displaceable from a first position during a stamping and pressing working stroke of the stamping and pressing die to a second position resting on said bottom element stop during a swaging working stroke of the stamping and pressing die, said cutting die is provided with an upper substantially circular end face oriented toward the plate sections to be worked, said end face further having said transverse groove in alignment with said tapered slots of said bottom die serving as a matrix during pressing and further having cutting edges thereon for severing a portion of said plate sections during stamping, said cutting edges being defined on oppositely-disposed longitudinal edges of said transverse groove and having a width corresponding to a width of a plate portion to be severed, said transverse groove having a depth at least the thickness of a first plate section associated therewith from which a first plate portion is severed, said transverse groove being adapted to receive said first severed plate portion, and wherein a second upper plate section is stamped, pressed and swaged to define a second swaged plate portion from which swaged material flows to fill a circular void defined between a wall of said central bore in said bottom die and the upper circular end face of the swaging die into the transverse groove of which the first severed plate portion has previously been received.

3. An apparatus for joining plate sections as defined by claim 2, further wherein reception of said first severed plate portion in said transverse groove provides a substantially flat surface upon which said second plate section can be swaged to provide integral tabs thereon.

4. An apparatus for joining plate sections as defined by claim 2, further wherein said stamping and pressing die is adapted to make said swaging die effect a stroke of a predetermined distance whereupon said swaging die abuts said bottom element stop, and said predetermined distance corresponds to a thickness desired of said second swaged plate portion.

5. An apparatus for joining plate sections as defined by claim 3, further wherein a resultant unit of the joined plate sections is formed wherein the integral tabs on the second swaged plate portion abuts an underside of said first plate section, said integral tabs serving to lock said plate sections together and prohibit disassembly thereof.

6. An apparatus for joining plate sections as defined by claim 2, further wherein said elastic element comprises a spring.

7. An apparatus for joining plate sections as defined by claim 2, further wherein said elastic element comprises a hydraulic means.

8. An apparatus for joining plate sections as defined by claim 5, further wherein upon retraction of said stamping die a force is applied by the elastic element upon the resultant unit of the joined plate sections so as to eject said unit from said press.

* * * * *